United States Patent [19]

Zimmerman

[11] Patent Number: 4,886,532

[45] Date of Patent: Dec. 12, 1989

[54] APPARATUS FOR REMOVING AND FILTERING DIRTY AIR FROM EQUIPMENT

[75] Inventor: Bernhard Zimmerman, Ebersbach, Fed. Rep. of Germany

[73] Assignee: Zinser Textilmaschinen GmbH, Fed. Rep. of Germany

[21] Appl. No.: 190,884

[22] Filed: May 6, 1988

[30] Foreign Application Priority Data

May 7, 1987 [DE] Fed. Rep. of Germany ..... 3715217

[51] Int. Cl.[4] ..... B01D 46/04

[52] U.S. Cl. ..... 55/302

[58] Field of Search ..... 55/302, 303, 309, 312–314, 55/461

[56] References Cited

U.S. PATENT DOCUMENTS 3,887,341 6/1975 Sutter ..... 55/303

4,353,721 10/1982 Mollstatter ..... 55/302

*Primary Examiner*—Bernard Nozick

*Attorney, Agent, or Firm*—Shefte, Pinckney & Sawyer

[57] ABSTRACT

Apparatus for removing and filtering dirty air from equipment such as textile spinning machines. The apparatus has a suction duct through which dirty air is drawn. An intermediate duct containing a filter unit extends from the suction duct to a blower that blows the air through a discharge duct. The intermediate duct and discharge duct are partially contiguous with a common wall that has a portion shiftable from a common wall disposition during normal operation to a common wall opening and air flow diverting position to reverse air flow through the filter unit for cleaning and to cause air to be drawn to the blower through the discahrge duct. The shiftable wall portion may be mounted for pivoting or for sliding. The intermediate duct and the discharge duct may be arranged parallel or in crossing relation and may be rectangular to semi-circular in cross-section.

14 Claims, 4 Drawing Sheets

APPARATUS FOR REMOVING AND FILTERING DIRTY AIR FROM EQUIPMENT

BACKGROUND OF THE INVENTION

The present invention relates to apparatus for removing and filtering dirty air from equipment such as textile spinning machines, and more particularly to such apparatus in which the air flow is reversed to dislodge accumulated residue in the filter unit.

Air cleaning devices of various sorts are well known in the art. Typical of these is the device disclosed in German published patent application No. 30 17 838 that includes a filter box having an untreated air chamber communicating with a suction duct that draws air from a spinning machine. Air passes through a filter between the untreated air chamber and a clean air chamber and a blower is located in the clean air chamber to create the air flow. A suction duct communicating between the untreated air chamber and a continuously operated central suction system is periodically opened briefly to draw reverse air flow through the filter to remove accumulated residue.

SUMMARY OF THE INVENTION

The purpose of the present invention is to provide an improved apparatus of the type known in the prior art with simplified filter cleaning capability. This purpose is obtained in the present invention by utilizing a suction duct through which dirty air is drawn from equipment such as textile spinning machines, which suction duct is connected to an intermediate duct that extends therefrom and has a filter unit disposed therein. A blower has its air intake at the outer end of the intermediate duct and a discharge duct has an inner end at the discharge of the blower. The intermediate and discharge ducts are at least partially contiguous and have a common wall with a portion shiftable between a common wall disposition in which air flows through the intermediate duct to the blower and from the blower through the discharge duct and an air flow diverting position in which the common wall is open to allow air flow between the intermediate and discharge ducts with one side of the shiftable wall portion diverting air flow from the blower and inner end of the discharge duct through the open common wall into the intermediate duct for reverse air flow to the filter unit for dislodging accumulated residue therefrom and the other side of the shiftable wall portion diverting flow of intake air to flow inwardly in the discharge duct beyond the shiftable wall portion through the open common wall and outer end of the intermediate duct to the blower intake. The shiftable wall portion may be a plate valve mounted for pivoting between the common wall disposition and the diverting position or it may be mounted for sliding across the intermediate and discharge ducts between the common wall disposition and the diverting position.

When using the pivotally mounted plate valve, the plate is preferably pivotable about an axis transverse to the direction of air flow in the intermediate and discharge ducts. In one form, the intermediate duct and discharge duct are semi-circular in cross-section with a generally common base and the plate valve has a circumferential curvature generally conforming to the adjacent surface configuration of the intermediate duct and discharge duct when the plate valve is in air flow diverting position.

In the embodiment in which the shiftable wall portion is mounted for sliding across the intermediate and discharge ducts, the shiftable wall portion preferably has a first component disposable in the common wall and slidable out of common wall disposition and a second component connected generally perpendicularly to the first component for sliding into air flow diverting position upon sliding of the first component out of common wall disposition. In the preferred form of this embodiment, the intermediate duct and the discharge duct are rectangular in cross-section and the second component of the shiftable wall portion is rectangular in cross-section generally conforming to the adjacent combined surface configuration of the intermediate and discharge ducts when the second component is in the air flow diverting position.

In one form of the invention, the intermediate duct and the discharge duct extend generally parallel at the common wall and in another form the intermediate duct and the discharge duct cross each other at the common wall, with the shiftable wall portion either being a plate valve pivoted about an axis extending generally diagonally to the intermediate duct and discharge duct or being a slidable portion extending diagonally across the intermediate and discharge duct when in the air flow diverting position.

Thus, the present invention provides a simple type of construction in which air flow can be used to clean the filter unit by simply shifting the common wall portion to divert the air from the blower back through the filter unit in a reverse direction to loosen and dislodge the accumulated residue and blow it into a waste collector. During this reverse blowing, the suction tube from the machine is closed so that the air carrying the waste from the filter unit will be directed into the waste collector.

The present invention has further advantages, such as minimum maintenance by eliminating the need for mechanical filter cleaners, cleaning of the filter in a short cycle, such as during the exchange of roving cans when used with a spinning machine, compactness, and easy access to the waste collector that can be exchanged when the machine is operating.

Other and further advantages and features of the present invention are apparent from the accompanying drawings and following detailed description of the preferred embodiment.

DETAILED DESCRIPTION OF THE PREFERRED EMBODIMENTS

Figure 1:
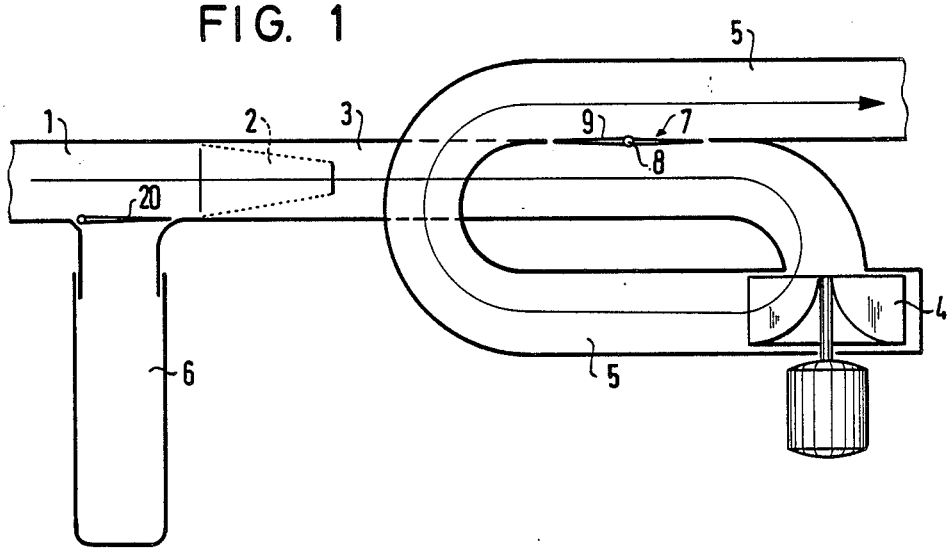
FIG. 1 is a schematic side elevation of one of the preferred embodiments of the apparatus for removing and filtering dirty air of the present invention, with the components in normal operating position.
Figure 2:
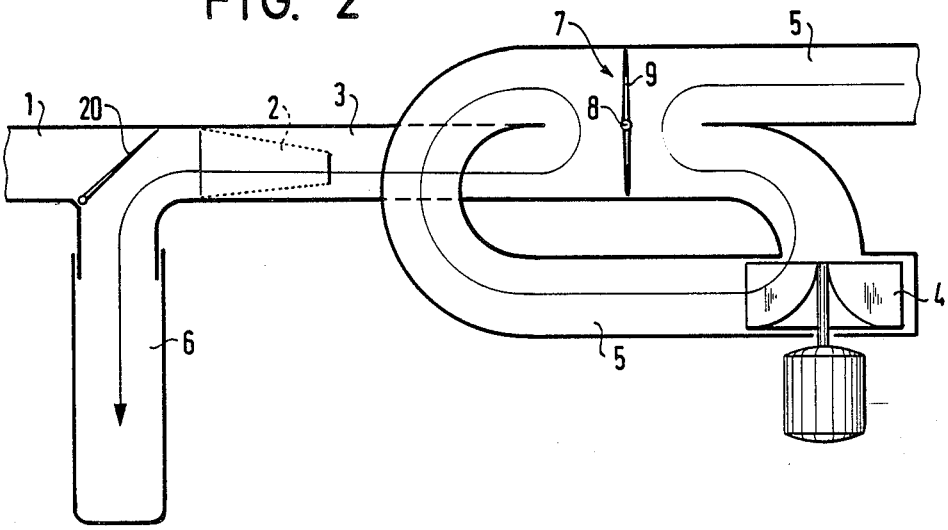
FIG. 2 is an illustration similar to FIG. 1, showing the components in filter cleaning position.

Referring first to FIGS. 1 and 2, apparatus 10 according to the first embodiment of the present invention is illustrated for removing and filtering dirty air from equipment. This may be used to remove dust and fiber fly at a spinning machine, although it could be used as well with other equipment. The particular equipment is not illustrated and the connection of the apparatus to the equipment is not shown as it does not form part of the present invention. As illustrated, a suction duct 1 leads from the equipment and is connected to an intermediate duct 3 in which a filter unit 2 is disposed. The intermediate duct 3 extends from the suction duct 1 to a blower 4 having its air intake at the outer end of the intermediate duct 3. A discharge duct 5 has its inner end at the discharge of the blower 4.

The intermediate and discharge ducts 3 and 5 are at least partially contiguous and have a common wall that includes a portion 7 shiftable between a common wall disposition in which air flows through the intermediate duct 3 to the blower 4 and from the blower 4 to the discharge duct 5 (FIG. 1) and an air flow diverting position (FIG. 2) in which the common wall is open to allow air flow between the intermediate and discharge ducts 3 and 5 with one side of the shiftable wall portion 7 diverting air flow from the blower 4 and inner end of the discharge duct 3 through the open common wall into the intermediate duct 3 for reverse air flow to the filter unit 2 for dislodging accumulated residue therefrom and the other side of the shiftable wall portion 7 diverting flow of intake air to flow inwardly in the discharge duct 5 beyond the shiftable wall portion 7 through the open common wall and outer end of the intermediate duct 3 to the intake of the blower 4.

In the form of the invention illustrated in FIGS. 1 and 2, the intermediate duct 3 and discharge duct 5 extend generally parallel at the common wall, and the shiftable wall component 7 is in the form of a plate valve 9 mounted for pivoting about an axis 8 transverse to the direction of air flow in the intermediate and discharge ducts 3 and 5. The plate valve can be actuated manually or by conventional electrical, pneumatic or hydraulic devices (not shown).

Below the suction duct 1 is a waste collector 6, which is closed, as illustrated in FIG. 1, by a pivoted valve plate 20. This valve plate 20 may be mechanically connected for operation with the plate valve 9 of the shiftable wall component or the valves could be connected together for simultaneous mechanical actuation.

In the normal operating condition, as illustrated in FIG. 1, air flows in the direction of the arrow from the suction duct 1 through the filter unit 2 and intermediate duct 3 to the blower 4, from which it is directed through the discharge duct 5. When the filter unit 2 is to be cleaned, the shiftable wall component plate valve 9 is pivoted about its axis 8 to the position shown in FIG. 2 and the plate valve 20 is pivoted to close the suction duct 1 and provide an opening to the waste collector 6. In this condition, the blower 4 draws air in through the discharge duct beyond the shiftable wall component, which air is diverted by the plate valve 9 into the outer end of the intermediate duct 3 to the intake of the blower, from which air is blown through the inner end of the discharge duct 5 to the plate valve 9, which diverts the air reversely through the intermediate duct 3 and filter unit 2 to dislodge the accumulated reside, which is blown with the air into the waste collector 6. Efficient filter cleaning in a rapid and simply way is thus possible solely through the brief shift of the plate valves 9 and 20.

Figure 3:
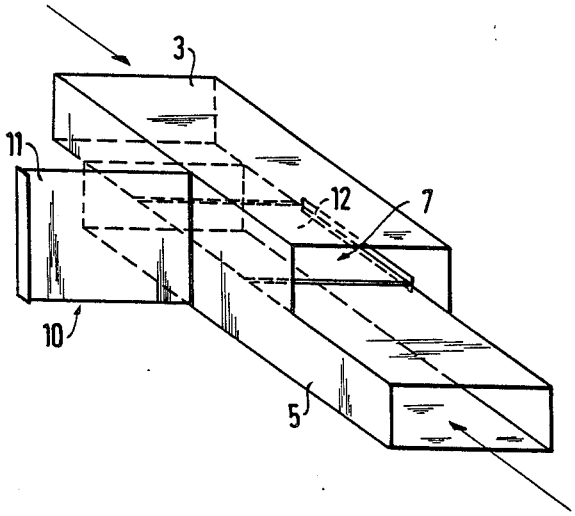
FIG. 3 is a perspective view of contiguous portions of the intermediate duct and discharge duct and the shiftable common wall portion of a second preferred embodiment of the present invention, with the components in normal operating position.
Figure 4:
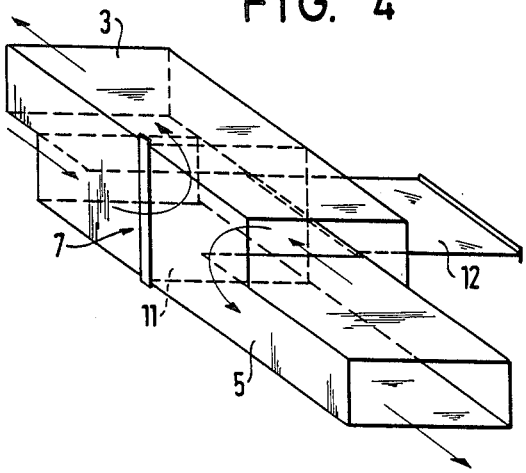
FIG. 4 is an illustration of the components of FIG. 3 shown in filter cleaning position.

A second embodiment is illustrated in FIGS. 3 and 4. This embodiment is similar to that of FIGS. 1 and 2 in that it includes parallel intermediate and discharge ducts 3 and 5. However, rather than using a pivoted plate valve, the apparatus of this embodiment utilizes a sliding wall portion 10 that has two rectangular components 11 and 12 connected perpendicularly to each other. The first component 12 of the shiftable wall portion 10 is disposable in the common wall and is slidable out of common wall disposition to open the common wall between the intermediate duct 3 and the discharge duct 5. The second component 11 of the shiftable common wall portion is slidable into air flow diverting position upon sliding of the first component 12 out of common wall disposition.

FIG. 3 illustrates the apparatus in normal operating position in which the first component 12 provides a separation of the intermediate duct 3 from the discharge duct 5 so that air flows in the direction of the arrow through the apparatus in the same manner as described in regard to FIG. 1 above. The filter cleaning condition is illustrated in FIG. 4, wherein the wall portion 10 is shown to have been shifted by sliding to shift the first component 12 out of common wall disposition, opening the common wall between the intermediate and discharge ducts 3 and 5, and the second component 11 is shifted into air flow diverting position for diverting the air flow in the same manner as illustrated and described in regard to FIG. 2 above.

Figure 5:
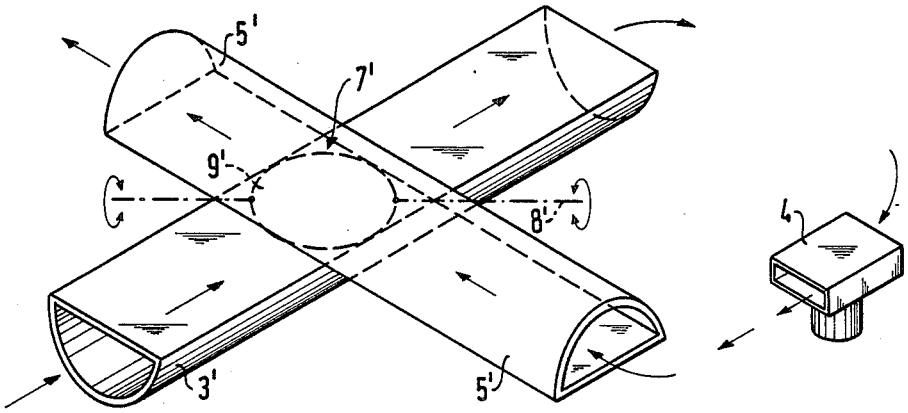
FIG. 5 is a perspective view of contiguous portions of the intermediate duct and discharge duct and the shiftable common wall portion of a third preferred embodiment of the present invention, with the components in normal operating position.
Figure 6:
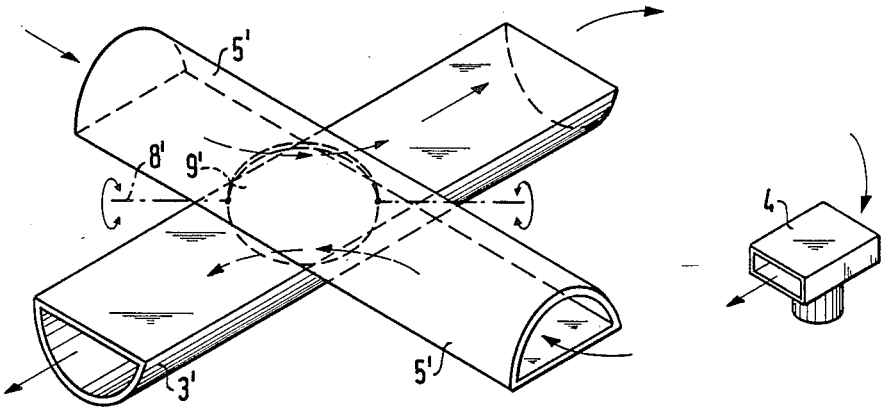
FIG. 6 is an illustration of the components of FIG. 5 shown in filter cleaning position.

A third embodiment of the apparatus of the present invention is illustrated in FIGS. 5 and 6, in which an intermediate duct 3' and a discharge duct 5' cross each other at the common wall, rather than being parallel as in the embodiments of FIGS. 1 and 2 and FIGS. 3 and 4. Each of the intermediate duct 3' and discharge ducts 5' are semi-circular in cross-section with a generally common base. The common wall is formed with a portion 7' that is in the form of a plate valve 9' having a circumferential curvature generally conforming to the adjacent surface configuration of the intermediate duct 3' and discharge duct 5' and pivoted about an axis 8' extending generally diagonally to the intermediate duct 3' and discharge duct 5'.

As seen in FIG. 5, during normal operation the air flows from the suction duct through a filter unit (not shown) into the intermediate duct 3' and through the blower 4 into the discharge duct 5'. When the apparatus is shifted for cleaning of the filter unit, as illustrated in FIG. 6, the plate valve 9' is pivoted about its axis 8' into a common wall opening position, which allows air to flow in the direction of the arrow from the discharge duct 5' into the intermediate duct 3' to apply a filter cleaning air flow as in the illustrations of FIGS. 2 and 4.

Figure 7:
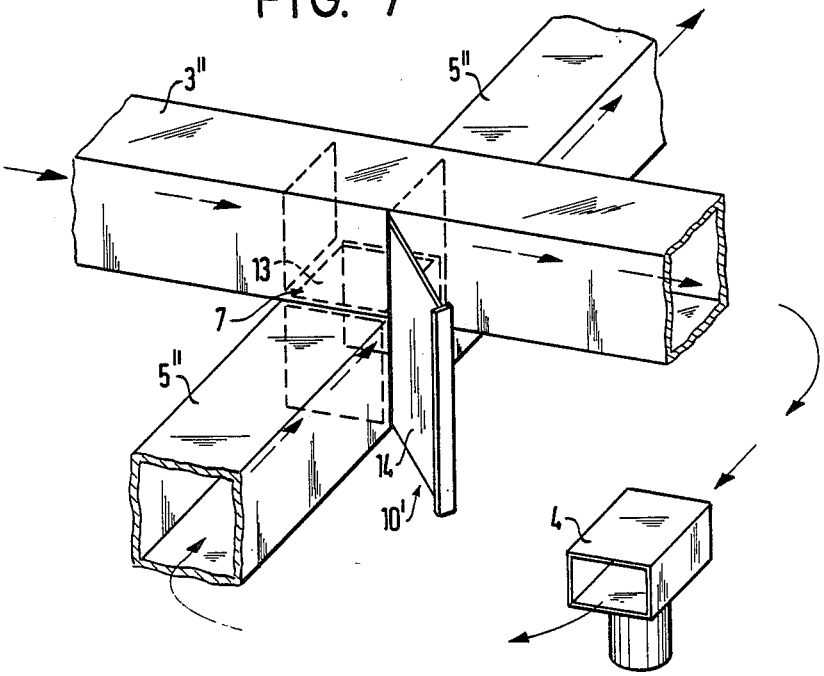
FIG. 7 is a perspective view of contiguous portions of the intermediate duct and discharge duct and the shiftable common wall portion of a fourth preferred embodiment of the present invention, with the components in normal operating position.
Figure 8:
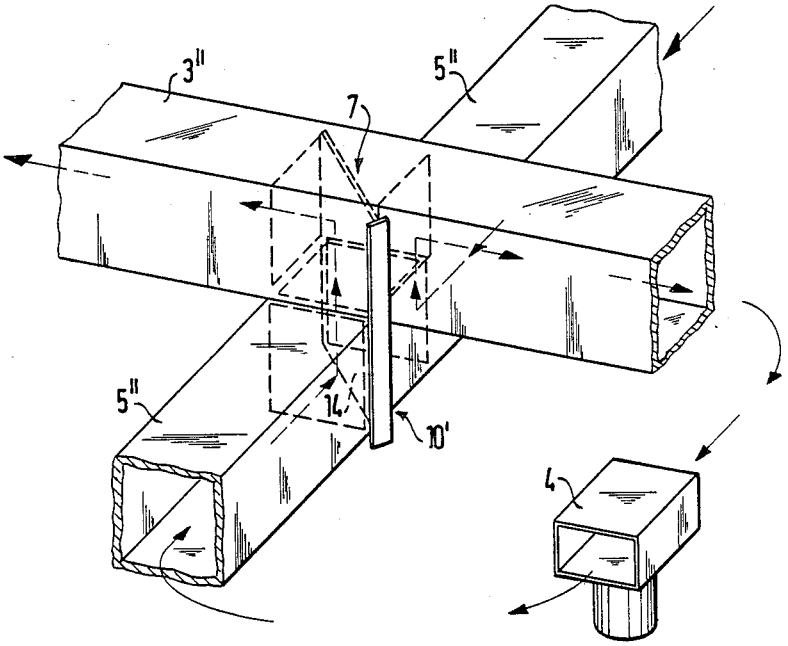
FIG. 8 is an illustration of the components of FIG. 7 shown in filter cleaning position.

A fourth embodiment of the present invention is illustrated in FIGS. 7 and 8. In this embodiment, the intermediate duct 3'' and the discharge duct 5'' also cross each other at the common wall as in the embodiment of FIGS. 5 and 6. In this embodiment the intermediate duct 3″ and the discharge duct 5″ are each rectangular in cross-section and the shiftable common wall portion 7 is in the form of a slidable portion 10′ generally similar to that described in regard to the embodiment of FIGS. 3 and 4 and having a first rectangular component 13 normally disposed in the common wall to provide a wall separation between the intermediate duct 3″ and the discharge duct 5″. A second component 14 is connected to the first component 13 in generally perpendicular relation and is slidable diagonally across the intermediate duct 3″ and the discharge duct 5″ to divert the air flow in the same manner as in the previously described embodiments. This second component 14 is rectangular in cross-section and conforms generally to the adjacent combined surface configuration of the intermediate and discharge ducts 3″ and 5″ when it is in air flow diverting position.

FIG. 7 illustrates the normal operating position of the apparatus of FIG. 8 illustrates the filter cleaning condition in which the first component 13 has been shifted out of the common wall location by shifting of the portion 10′, and the second component 14 has been shifted into air flow diverting position to subject the filter unit to a cleaning action.

As a result of the construction of the present invention wherein the intermediate duct and the discharge duct have a common wall that is shiftable between two positions, the invention provides an easy means for briefly cleaning a filter unit in a simple and virtually maintenance-free arrangement.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for removing and filtering dirty air from equipment such as textile spinning machines, comprising:

a suction duct through which dirty air is drawn from the equipment;

an intermediate duct communicated with said suction duct and extending therefrom to an outer end;

a filter unit disposed in said intermediate duct;

a blower having its air intake at said outer end of said intermediate duct;

a discharge duct having an inner end at the discharge of said blower and an outer end;

said intermediate and discharge ducts being at least partially contiguous along a common wall and being communicated with one another across a common opening in said common wall, said ducts defining a chamber surrounding said opening, said chamber having two inlets and two outlets, each inlet being associated with a respective outlet, and a shiftable wall portion; and means for shifting said shiftable wall portion within said chamber, said shiftable wall portion being shiftable between a common wall disposition in which it closes said common opening, whereby said intermediate duct defines one associated pair of said chamber inlets and outlets and said discharge duct defines the other associated pair of said chamber inlets and outlets and air flows through said intermediate duct to said blower air intake and is discharged along said discharge duct and through said discharge duct outer end, and a reverse air flow diverting disposition in which said shiftable wall portion is positioned across said chamber generally transversely of said common opening, whereby air is flowed through said discharge duct and diverted by one side of said shiftable wall portion into said intermediate duct, with said intermediate duct and said discharge duct defining one associated pair of said chamber inlets and outlets with respect to the air diverted by said one side of said shiftable wall portion, the air then being discharged by said blower through said discharge duct and diverted by the other side of said shiftable wall portion into said intermediate duct, with said intermediate duct and said discharge duct defining the other associated pair of said chamber inlets and outlets with respect to the air diverted by said other side of said shiftable wall portion and the reverse air flow impacting said filter unit to dislodge accumulated residue therefrom.

2. Apparatus according to claim 1 and characterized further in that said shiftable wall portion is a plate valve mounted for pivoting between said common wall disposition and said diverting position.

3. Apparatus according to claim 2 and characterized further in that said shiftable wall portion is pivotable about an axis transverse to the direction of air flow in said intermediate and discharge ducts.

4. Apparatus according to claim 2 and characterized further in that said intermediate duct and said discharge duct cross each other at said common wall and said plate valve pivots about an axis extending generally diagonally to said intermediate duct and said discharge duct.

5. Apparatus according to claim 2, 3 or 4 and characterized further in that said intermediate duct and said discharge duct are semicircular in cross-section with a generally common base and said plate valve has a circumferential curvature generally conforming to the adjacent surface configuration of the intermediate duct and discharge duct when said plate valve is in said air flow diverting position.

6. Apparatus according to claim 5 and characterized further in that said intermediate duct and said discharge duct extend generally parallel at said common wall.

7. Apparatus according to claim 5 and characterized further in that said intermediate duct and said discharge duct cross each other at said common wall.

8. Apparatus according to claim 1 and characterized further in that said shiftable wall portion is mounted for sliding across said intermediate and discharge ducts between said common wall disposition and said diverting position.

9. Apparatus according to claim 8 and characterized further in that said shiftable wall portion has a first component disposable in said common wall and slidable out of common wall disposition and a second component connected generally perpendicularly to said first component for sliding into air flow diverting position upon sliding of said first component out of common wall disposition.

10. Apparatus according to claim 9 and characterized further in that said intermediate duct and said discharge duct are rectangular in cross-section and said second component of said shiftable wall portion is rectangular in cross-section generally conforming to the adjacent combined surface configuration of said intermediate and discharge ducts when said second component is in said air flow diverting position.

11. Apparatus according to claim 10 and characterized further in that said intermediate duct and said discharge duct extend generally parallel at said common wall.

12. Apparatus according to claim 10 and characterized further in that said intermediate duct and said discharge duct cross each other at said common wall, and said second component extends diagonally across said intermediate and discharge ducts when in said air flow diverting position.

13. Apparatus according to claim 1, 2, 3, 4 or 5 and characterized further in that said intermediate duct and said discharge duct extend generally parallel at said common wall.

14. Apparatus according to claim 1, 2, 3, 4 or 5 and characterized further in that said intermediate duct and said discharge duct cross each other at said common wall.

* * * * *